United States Patent [19]

Muraour

[11] Patent Number: 4,796,889

[45] Date of Patent: Jan. 10, 1989

[54] TIP FOR TENNIS RACKET HANDLE AND THE LIKE, AND RACKET EQUIPPED WITH THIS TIP

[76] Inventor: Renaud Muraour, 57 avenue de Saint-Paul, Montelimar, Drome, France

[21] Appl. No.: 133,725

[22] Filed: Dec. 15, 1987

[30] Foreign Application Priority Data

Dec. 19, 1986 [FR] France ..... 86 18456
Nov. 2, 1987 [EP] European Pat. Off. ..... 87420300.3

[51] Int. Cl.[4] ..... A63B 49/00
[52] U.S. Cl. ..... 273/73 J; 273/75
[58] Field of Search ..... 273/73 J, 75, 26 B, 273/72 R, 163 R, 163 A, 164

[56] References Cited

U.S. PATENT DOCUMENTS 1,917,236 7/1933 Bloomstrand ..... 434/247
2,023,843 12/1935 Kleinman ..... 273/736

FOREIGN PATENT DOCUMENTS 850481 11/1985 PCT Int'l Appl. ..... 273/75
8701602 3/1987 PCT Int'l Appl. ..... 273/73 J
323485 1/1930 United Kingdom .
345584 3/1931 United Kingdom .

*Primary Examiner*—Robert E. Garrett
*Assistant Examiner*—Thomas Denion
*Attorney, Agent, or Firm*—Browdy and Neimark

[57] ABSTRACT

A tip for a racket comprises a flat element whose octagonal perimeter corresponds to that of the cross section of the free end of the racket handle. The top comprises at least two adjacent differentiated triangular sectors whose one vertex coincides with the longitudinal axis of the handle, and whose side opposite this vertex comprises one of the adjacent sides of the octagonal perimeter. The element is designed to be fastened to the free end of the racket handle in a determined angular position so that the differentiation of triangular sectors permits a correct angular positioning of the handle relative to a precise point of the player's hand.

10 Claims, 3 Drawing Sheets

TIP FOR TENNIS RACKET HANDLE AND THE LIKE, AND RACKET EQUIPPED WITH THIS TIP

FIELD OF THE INVENTION

The present invention relates to a tip for tennis racket handle and the like, and a racket equipped with this tip, which is intended to be applied against the free end of this handle or optionally to constitute its closing element if this handle is tubular.

BACKGROUND OF THE INVENTION

It is known that the grip of the racket, i.e., the angular position of the handle in the tennis player's hand or the like is determined by the nature of the stroke that this player is ready to execute, such as flat, sliced or lifted forehand, flat, sliced or lifted backhand, service and smash.

During his training and despite the octagonal shape, regular or not, of the cross section of the racket handles, it is difficult, particularly for a beginning player, to find and consequently to adopt the best grip before each of his strokes.

SUMMARY OF THE INVENTION

This invention aims at remedying this drawback by providing means making possible an easy location of the best grip of the racket.

For this purpose, this tip of the racket handle of the present invention comprises at least one flat element whose octagonal perimeter corresponds approximately to that of the cross section of the free end of the racket handle and which comprises at least two adjacent differentiated triangular sectors, the vertex of which coincides with the longitudinal axis of the handle and whose side opposite this vertex is constituted by one of the adjacent sides of its octagonal perimeter. This element is intended to be fastened to the free end of the handle in a determined angular position, the differentiation of the triangular sectors permitting a correct angular positioning of the handle relative to a precise point of the player's hand.

It then suffices to indicate to the player the position that, for each stroke planned, one of these sectors should occupy relative to a precise point of his hand which hold the racket, for him to adopt a good grip of the racket quickly and easily.

For example, if the precise point of the hand to be considered is the hypothenar eminence, the tip is fastened to the free end of the handle so that the differentiated triangular sectors are consequently placed relative to the median plane of the racket frame, i.e., its face, so that each of them correspond to the zone of the handle which should be covered by the hypothenar eminence of the player's hand for the execution of a determined stroke.

It can easily be seen that this tip considerably facilitates games requiring the use of a racket.

The flat element can simply consist of a self-adhesive film or a rigid plate fastened, in any suitable way, to the free end of the handle or also comprising the closing element of the handle when the latter is tubular.

According t a simple embodiment of the invention, each of the triangular sectors of the tip has its own color, which differentiates it from the others.

In case the tip of the racket handle comprises a cabochon, or convex element, that can be fitted on the free end of the handle, i.e., in case the flat element of the tip is bordered by a cylindrical ferrule which can take the shape the perimeter of the free end of the handle by clamping it, each triangular sector carried by the flat element of the tip is extended, on the outside face of its ferrule, by a cylindrical sector whose distinctive characteristic, color or other, is the same.

In case the handle carries, at its end connected to the racket frame, a ring consisting of a ferrule taking the shape of its perimeter by clamping it, it is possible to provide, on the outside face of this ring, cylindrical sectors located in the extension of those of the ferrule of the tip and carrying the same distinctive signs as they do.

According to another embodiment of the invention, to allow the player to make his racket handle pivot 180° without losing the advantage of sectorial marks, two sets of triangular and cylindrical sectors are provided on the tip and, optionally, the ring, the second set being placed symmetrically to the first relative to the axis of the handle.

BRIEF DESCRIPTION OF THE DRAWINGS

In any case, the invention will be better understood with the help of the following description, with reference to the accompanying diagrammatic drawing representing, by way of nonlimiting example, an embodiment of this tip and its mode of use.

DETAILED DESCRIPTION OF THE INVENTION

Figure 1:
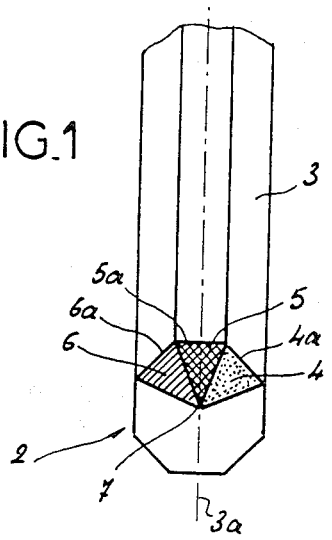
FIG. 1 is a perspective view of the free end of a tennis racket handle equipped with a tip according to the present invention.

As FIG. 1 shows, tip 2 according to the invention consists of a flat element in the form of a film, sheet or plate, whose perimeter is adapted to that of the cross section of the free end of handle 3 of a racket. The perimeter therefore is octagonal.

This tip 2 is intended to be fastened, by any suitable means, against the free end of handle 3 of the racket, or it can also constitute the closing element of this handle when it is tubular, which often is encountered.

This tip 2 exhibits three differentiated triangular sectors 4, 5 and 6. Each triangular sector has a vertex 7 coinciding with longitudinal axis 3*a* of handle 3, while the side opposite this vertex 7 of each of triangular sectors 4, 5 and 6 consists of one of three adjacent sides 4*a*, 5*a* and 6*a* of the octagonal perimeter of tip 2.

Figure 2:
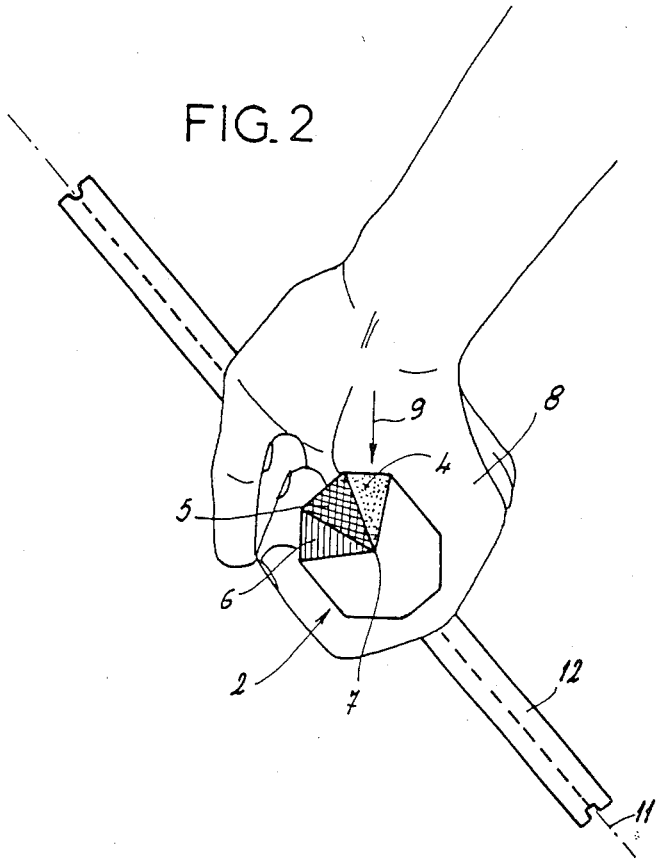
FIGS. 2, 3 and 4 are rear views of this tennis racket, held by a right-handed tennis player, illustrating three grips of different rackets corresponding, respectively, to a forehand, service, normal backhand, or a smash or a lifted backhand.
Figure 3:
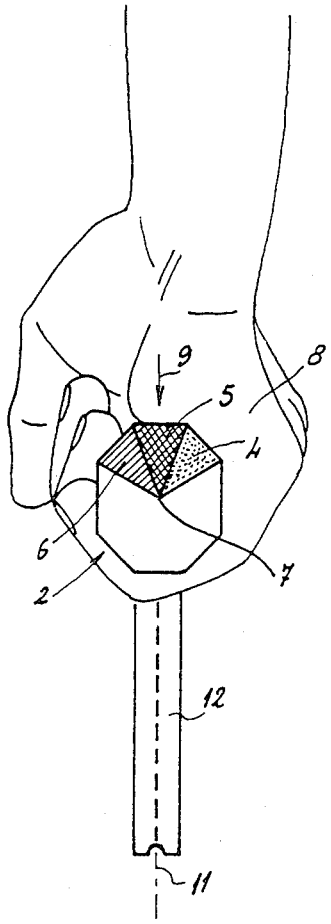
Figure 4:
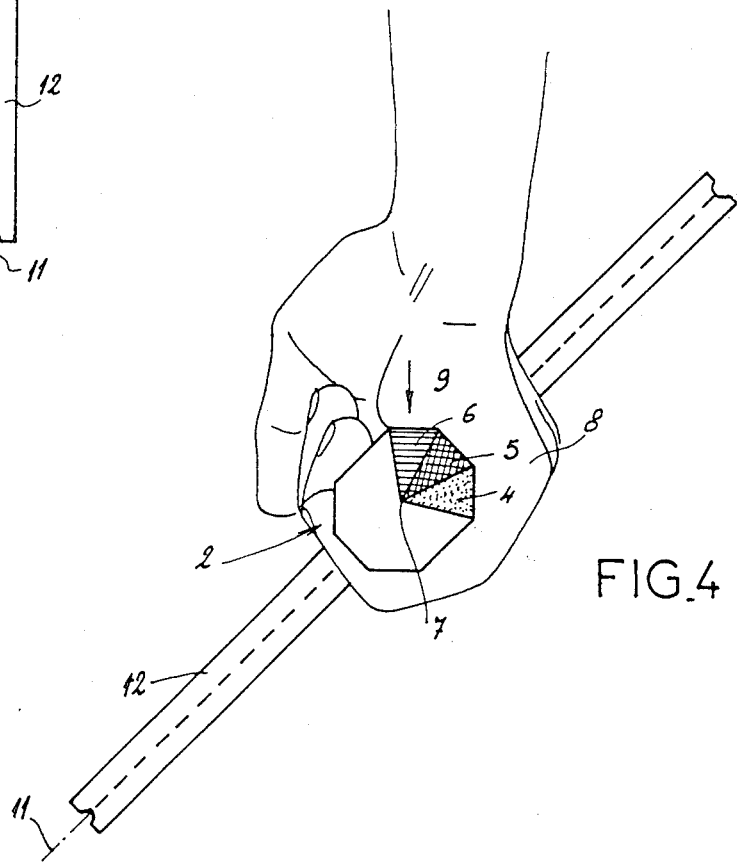

Each triangular sector 4, 5 and 6 is intended to designate the zone of handle 3 which is to be covered by the hypothenar eminence of hand 8 of the player. In FIGS. 2 to 4, this hypothenar eminence is marked by arrow 9.

The differentiation between the different triangular sectors 4, 5 and 6 can be made in any suitable way and particularly by different colorings. It will therefore be easy for the beginning player to grasp handle 3 of his racket with the good angular position, i.e., to adopt a good grip of the racket; for this it will suffice for him to know what zone, corresponding to one of the three triangular sectors 4, 5, 6, should be covered by his hypothenar eminence 9 for each of the strokes that he can perform.

Consequently, to adopt a good racket grip, it will suffice for the player to know:

that to execute a forehand stroke, he must hold handle 3 of his racket so that his hypothenar eminence covers the zone of his handle corresponding to triangular sector 4, as illustrated in FIG. 2, that to execute a service, a normal backhand or a smash, his hypothenar eminence 9 should cover the zone of handle 3 corresponding to triangular sector 5, as illustrated in FIG. 3,—and that, finally, to execute a lifted backhand, he must hold handle 3 so that his hypothenar eminence 9 covers the zone of his handle 3 corresponding to triangular sector 6, as illustrated in FIG. 4.

Of course, tip 2 should be fastened to the free end of handle 3 of the racket with a angular position predetermined by the point of reference prescribed by the player's hand. In the example cited above, where this reference point is the hypothenar eminence, tip 2 should be positioned angularly so that the three triangular sectors 4, 5 and 6 are placed symmetrically relative to median plane 11 of frame 12 of the racket, which is also the plane of its face. This correct positioning is obviously that shown by FIGS. 2 to 4 of the drawing.

This tip 2 can be made in different ways depending on whether it consists of an accessory adaptable to a racket or it is associated with it from the time of production of the handle. Actually, it can be quite simply a self-adhesive film applied to the free end of handle 3 of a racket, or again a rigid plate of plastic or the like, equipped with means making possible its fastening to the free end of handle 3 of a racket. As indicated above, it can also constitute the closing element of a racket handle 3 when the latter is tubular.

Figure 5:
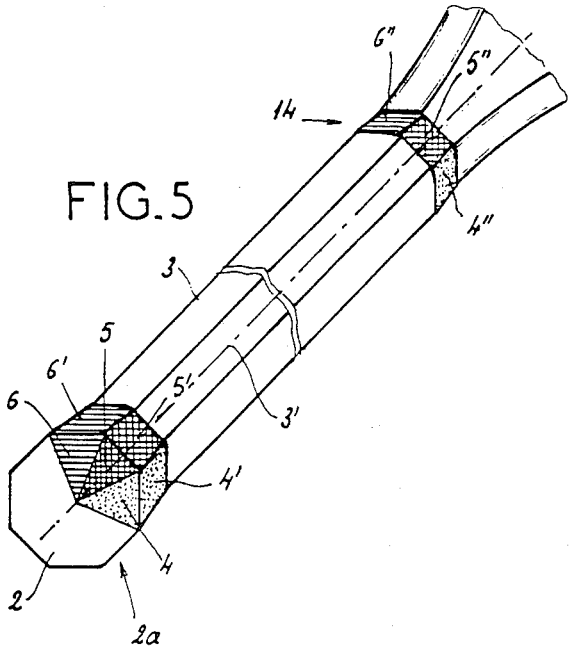
FIG. 5 is a perspective view of the free end of a racket handle equipped with a tip according to another embodiment of the present invention.

This tip can also consist of a cabochon, as illustrated by FIG. 5 where it is designated by reference 2*a*. In this case, flat element 2, serving as a bottom for it, is bordered by a cylindrical peripheral ferrule 2'*a* whose polygonal cross section corresponds to that of handle 3 of racket. This ferrule 2'*a* is dimensioned to be able to be engaged on the free end of handle 3 of the racket by clamping it radially. In this case, each triangular sector 4, 5 and 6 is extended, on the outside face of ferrule 2'*a*, by a cylindrical sector carrying the same distinctive sign as it, respectively 4', 5' and 6'. This facilitates the location by the player of the good grip of the racket since this arrangement makes the sectors easier to see.

To facilitate marking of the good grip of the racket still more by the player, according to another characteristic of the invention and in case handle 3 of the racket is equipped with a ring, at its end opposite its free end carrying tip 2, cylindrical sectors 4'', 5'', 6'' are provided on the outside face of this ring, each of which is placed in the extension of one of cylindrical sectors 4' to 6' of ferrule 2'*a* of tip 2*a*.

Figure 6:
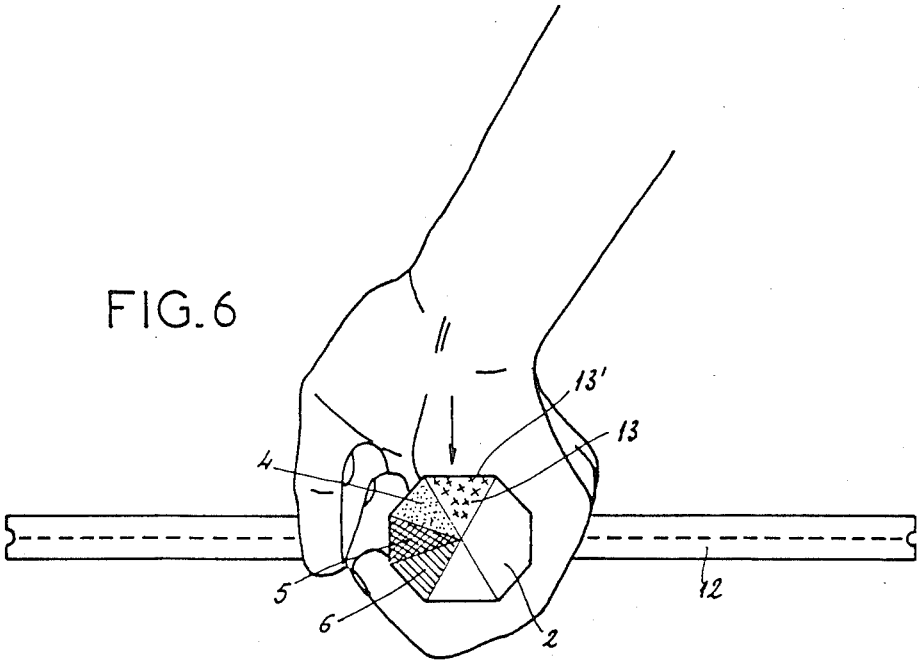
FIG. 6 is a view similar to FIG. 2 illustrating a mode of use of the racket, in addition to those illustrated by FIGS. 2 to 4.

FIG. 6, which is a view similar to FIGS. 2 to 4, shows this racket tip, whether or not it is equipped with a ferrule 2'*a*, in the case where it carries a fourth triangular sector, and optionally a cylindrical sector, different from the first three and designated by reference 13 and 13' respectively. These sectors 13, 13' correspond to a racket grip making it possible to increase the lift effect in the forehand stroke, this grip of the racket generally being called the "western grip." However, it should be noted that this grip requires great experience in the practice of tennis and therefore is reserved only for good players.

Figure 7:
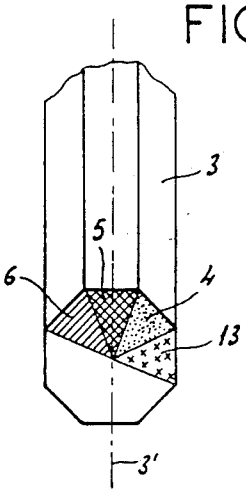
FIG. 7 is a view similar to FIG. 1 showing another embodiment of the tip according to the present invention.

FIG. 7 shows another embodiment of the tip of the invention, whether or not this tip comprises a cylindrical ferrule 2'*a*. Starting from the principle that the three or four triangular sectors 4 to 6 and 13 and optionally cylindrical sectors 4' to 6' and 13' and 4'' to 6'' and 13'' do not extend over more than 180°, two sets of triangular and optionally cylindrical sectors are provided, placed symmetrically relative to axis 3' of handle 3 of the racket. This arrangement allows the player to make his racket pivot 180° without losing the benefit of the present one of the triangular or cylindrical sectorial marks facilitating his racket grip.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology employed herein is for the purpose of description and not of limitation.

What is claimed is:

1. A tip for a free end of a racket handle comprising:

a flat element having an octagonal perimeter corresponding to the perimeter of the cross section of the free end of the racket handle;

said element comprising at least two adjacent differentiated triangular sectors;

said triangular sectors having one vertex which coincides with the longitudinal axis of said handle;

the side of said triangular sectors opposite this vertex comprising one of the adjacent sides of said octagonal perimeter;

said element being adapted and constructed to be fastened to said free end of said handle in such position whereby the differentiation of the triangular sectors permits correct angular positioning of said handle relative to a precise point of the hand of the user of the racket.

2. The tip according to claim 1 wherein the point on the hand of the user is the hypothenar eminence thereof, and the tip is fastened to the free end of said handle so that the differentiated triangular sectors are placed relative to a median plane of said racket frame so that each sector corresponds to a zone of said handle which should be covered by the hypothenar eminence of the player's hand for the execution of a predetermined stroke.

3. The tip according to claim 1 in the form of a self-adhesive film applied to the free end of the handle of the racket.

4. The tip according to claim 1 in the form of a rigid plate fastened to the free end of the handle of the racket.

5. The tip according to claim 1 wherein the handle is tubular in shape and the tip comprises the closing element of the free end of the handle.

6. The tip according to claim 1 wherein said tip is shaped as a cabochon comprising a flat element or bottom plate and a cylindrical ferrule capable of taking the shape of the perimeter of the free end of the handle by clamping.

7. The tip according to claim 6 wherein each triangular sector carried by the flat element of the tip is extended on the outside face of its ferrule by a cylindrical sector.

8. The tip according to claim 7 wherein the handle is equipped with a ring comprising a ferrule in the shape of the perimeter of the handle;

said ring being provided with cylindrical sectors, each of which sectors is located in the extension of one of the sectors of the ferrule of the tip and carrying the same sign as each sector.

9. The tip according to claim 1 wherein a first set and a second set of triangular sectors and cylindrical sectors are provided on the tip;

the second set of sectors being placed symmetrically to said first set of sectors relative to the axis of the handle.

10. The tip according to claim 1 wherein each of the triangular sectors has its own color which differentiates it from the other two.

* * * * *